United States Patent [19]

Hayes

[11] 4,173,546

[45] Nov. 6, 1979

[54] METHOD OF TREATING WASTE MATERIAL CONTAINING RADIOACTIVE CESIUM ISOTOPES

[76] Inventor: John F. Hayes, 25305 Country Club Blvd., North Olmsted, Ohio 44070

[21] Appl. No.: 900,076

[22] Filed: Apr. 26, 1978

Related U.S. Application Data

[63] Continuation of Ser. No. 708,473, Jul. 26, 1976, abandoned.

[51] Int. Cl.[2] ..... G21F 9/16

[52] U.S. Cl. ..... 252/301.1 W

[58] Field of Search ..... 252/301.1 W; 106/76, 106/77, 78, 83

[56] References Cited

U.S. PATENT DOCUMENTS

| | | | |
|---|---|---|---|
| 1,847,366 | 3/1932 | Spencer | 106/75 |
| 2,462,538 | 2/1949 | Nagel | 106/78 |
| 2,876,123 | 3/1959 | Drummond | 106/76 |
| 3,841,102 | 12/1974 | Cinner | 210/170 |
| 3,988,258 | 10/1976 | Curtiss et al. | 252/301.1 W |

FOREIGN PATENT DOCUMENTS 2228938 1/1974 Fed. Rep. of Germany .

OTHER PUBLICATIONS

Jacobs, D. G., "Cesium Exchange Properties of Vermiculite," Nuclear Science and Engineering, 12, 285–292, (1962).

Emura, S. et al., "Safety Assessment of Radioactive Waste-Cement Composites," Chem. Abstracts #83:151803d, (Nov. 1975).

Yamamoto et al., "Radioactivity Release Test of Concrete Caves," Chem. Abstracts #74:59865s, (Mar. 1971).

*Primary Examiner*—Benjamin R. Padgett
*Assistant Examiner*—Deborah L. Kyle
*Attorney, Agent, or Firm*—Fay & Sharpe

[57] ABSTRACT

A method is provided for treating waste materials containing radioactive cesium isotopes which comprises mixing an aqueous solution of an alkali metal silicate, a silicate hardening agent and a plurality of shale particles with such waste material and then solidifying the mixture to form a solidified mass which when subjected to an aqueous environment is characterized by the relatively low leachability of cesium isotopes therefrom.

14 Claims, No Drawings

METHOD OF TREATING WASTE MATERIAL CONTAINING RADIOACTIVE CESIUM ISOTOPES

This is a continuation, of application Ser. No. 708,473, filed July 26, 1976, now abandoned.

BACKGROUND OF THE INVENTION

1. Field of the Invention

The present invention relates to a method of treating waste materials which contain radioactive isotopes of cesium. More specifically, the instant invention concerns a method of treating waste material, usually liquids, which is contaminated with cesium isotopes to thereby contain or control the mobility of such cesium isotopes when the so-treated waste material is exposed to the leaching action of an aqueous environment.

2. Description of the Prior Art

In the nuclear field, for example in the generation of electric power by means of a nuclear reactor, cooling fluids are used which occasionally become contaminated with various radioactive substances. Obviously, a means must be provided for preventing these materials from coming into contact with the general environment.

To date, various techniques have been developed in an attempt to obviate this problem. For example, in the treating of liquids which are contaminated with radioactive materials evaporation, carrier precipitation (coagulation), sand filtration, ion exchange (including natural clays), electrodialysis, metallic displacement or scrubbing, solvent extraction, biological processes and crystallization have all been utilized. While these techniques have experienced varying degrees of success, they all suffer for one common defect in that all of the radioactive contamination cannot be removed from the liquid being treated.

Presently, when it is desired to contain or immobilize all of the radioactive contamination found in a waste material, the waste material is solidified if it is in a liquid state and encapsulated if it is in the form of a solid.

In the treatment of liquids, the waste is put into a containing vessel and then solidified by the addition thereto of a material such as Portland cement. The same general procedure is utilized to treat solid waste material. That is, it is positioned in a container and subsequently encapsulated by the addition thereto of a cementitious potting material.

Containers of the above described type are then taken to an interim storage area, which may be above or below ground level, or buried permanently in an approved land fill. While this is generally a highly effective way of containing radioactive waste material, it is not entirely satisfactory in certain circumstances. For example, if the solidified or encapsulated waste material contains radioactive cesium isotopes, especially cesium 137, and it eventually comes into contact with an aqueous environment there is a tendency for the cesium to be leached out of the treated waste material. These radioactive cesium isotopes then contaminate the surrounding area.

Various attempts have been made to reduce the leachability of radioactive cesium isotopes from solidified waste material of the above described type. For example, such materials as Grundite, (an illite type of clay), pottery clay and Conasauga shale have all been added to various grouts used to solidify isotopes which might be present. While such additives did reduce the leachability of such isotopes to some degree, they did not do so in a completely satisfactory manner. That is, undesirable amounts of cesium still can be leached out of such solidified materials when they are contacted by an aqueous leachant.

In addition, a relatively new technique described in U.S. Pat. No. 3,841,102 for improving the quality of leachate from sanitary landfills has also been evaluated as a means of immobilizing radioactive cesium isotopes found in certain liquid wastes. In the use of this technique, cement and an alkali metal silicate are used to solidify the waste material. However, while this approach has met with some limited success, it still has not resulted in a system which immobilizes radioactive cesium isotopes to a desirable degree. That is, radioactive cesium isotopes are still easily leached from so-treated and solidified waste material.

Accordingly, it is the principal object of the invention to overcome the difficulties experienced by prior art means for treating waste material which is contaminated with radioactive cesium isotopes.

Other objects of the invention will become apparent to those skilled in the art from a reading of the specification and claims.

SUMMARY OF THE INVENTION

The crux of the present invention resides in the unexpected discovery that when liquid waste material which is contaminated with radioactive cesium isotopes is solidified by adding thereto a mixture of aqueous alkali metal silicate, an alkali metal silicate hardening agent and a plurality of shale particles the radioactive cesium isotopes in the resultant solidified mass are rendered essentially immobile. That is, they essentially cannot be leached out of the so-produced mass by bringing it into contact with an aqueous environment.

The foregoing effect is startling in view of prior art practice. As before noted, mixtures of cement and shale, together with other additives such as fly ash, have been tried, without the desired degree of success, as a means of treating radioactive cesium isotope containing liquid waste material. Typical results achieved by this technique are shown in Table 1.

Likewise, attempts have been made to treat radioactive cesium isotope containing liquid waste material by solidifying it with a mixture of cement and an aqueous alkali metal silicate. These attempts have not produced satisfactory results. In fact, such a mixture is often inferior to the use of cement alone. Typical results realized by this technique are presented in Table 1.

As is seen from a study of Table 1, the results realized by the practice of the present invention are spectacular. This table clearly shows that synergistic results are realized when radioactive cesium isotopes are rendered immobile by solidifying (treating) such cesium containing liquid waste material by adding thereto a mixture of an aqueous solution of alkali metal silicate, an alkali metal silicate hardening agent and a plurality of particles of shale which have the ability to ion exchange with the cesium. As is noted, this table clearly shows that the radioactive cesium isotopes are rendered essentially immobile by the practice of the present invention whereas prior art methods do not provide a satisfactory means for accomplishing this. Clearly, such results are in no way even remotely suggested by the prior art techniques for treating similar waste material.

Again, referring to Table 1, it is readily apparent that the present invention for the first time provides a practical, economical and most importantly safe means for treating liquid waste material which contains radioactive cesium isotopes. The present invention overcomes a problem which has plaqued the nuclear waste treatment industry for years. It represents a significant technological breakthrough and for the first time provides a reliable means for treating radioactive cesium containing waste material.

In one aspect, the present invention concerns a means for reducing the leachability of radioactive cesium isotopes from cesium isotope containing waste material which is to be disposed of by solidification. This is accomplished by a process which includes forming a mixture of radioactive cesium isotope containing waste material, an aqueous solution of alkali metal silicate, an alkali metal hardening agent, and a plurality of shale particles and then solidifying the so-formed mixture. When the so-produced solidified mass is subjected to an aqueous environment, such as trickling or percolating water, the radioactive cesium isotopes contained therein are relatively immobile.

In another aspect, the present invention concerns a means for containing radioactive cesium isotopes which may be leached from waste material placed in a landfill. This feature of the invention is accomplished by applying over the receiving surface of the landfill a solidified cesium barrier layer formed from a mixture of an aqueous solution of an alkali metal silicate, an alkali metal silicate hardening agent, and a plurality of shale particles.

DESCRIPTION OF THE PREFERRED EMBODIMENTS OF THE INVENTION

The preferred practice of the invention concerns the treatment of liquid or semi-liquid waste material which is contaminated with radioactive cesium isotopes. As before mentioned, the primary source of such wastes are nuclear reactors. Usually such waste material is water. However, oftentimes it is an oil or an emulsion of oil and water or a chemical sludge.

In practice, the waste material is placed into a suitable container, such as a steel barrel or the like. To this waste material is then added an aqueous solution of alkali metal silicate, an alkali metal silicate hardening agent and a plurality of shale particles. The exact sequence in which these ingredients are added to the waste material is not critical. However, when the alkali metal silicate hardening agent is cement, it is preferred to add the cement before the alkali metal silicate. The shale particles can be added at any time before solidification occurs. If desired, it is possible to simply mix the waste with the various components of the material of the invention as they are fed into the desired container.

In the practice of the invention, any alkali metal silicate can be utilized. All that is required is that it be soluble in water. For example, potassium silicate and lithium silicate are suitable, but they are generally too expensive to be practical and are often difficult to obtain. Sodium silicate is ideal because it is relatively inexpensive and is generally available throughout the United States in either liquid or solid form. The liquid silicate is commercially available in a variety of ratios of $Na_2O$ to $SiO_2$.

The sodium silicate will ordinarily be used in liquid form, but if for any reason it is desired to use solid silicate, water may be added to the mixture in the form of a solution of hardening agent or simply as water.

Various hardening agents can be used in the practice of the invention. In general, acids or acidic materials act promptly to cause gelation, or hardening of the silicate. If the hardening agent is to be added to the mixture, it should be a polyvalent metal compound; that is, a composition containing polyvalent metal ions. It has been found that hardening agents which are only slightly soluble or compositions containing only small amounts of soluble hardening agents are most desirable for commercial use with this process. Typical hardening agents are Portland cement, lime, gypsum and calcium carbonate, which are the least expensive and most available, although aluminum, iron, magnesium, nickel, chromium, manganese or copper compounds could be used, but they are more expensive and difficult to obtain. Portland cement, lime and gypsum have a quick gel forming reaction, which is highly desirable, and then continue with a hardening reaction over a period of time. The properties of Portland cement as a setting agent are excellent. In addition, it is economical and readily available in large quantities throughout the United States. Also, its reaction rate with the silicate is easily controllable.

As is well known, shale a material which has a definite geological form. Basically, shale is a fine-grained sedimentary rock whose original constituents were clays or muds. It is characterized by thin laminae breaking with an irregular curving fracture, often splintery, and parallel to the often indistinguishable bedding planes. In the practice of the invention, shale having a particle size ranging from about 8 mm. to through 200 mesh have been used successfully. The exact particle size of the shale is not critical. All that is required is that the shale have a relatively high cation exchange capacity for cesium and that enough shale be used to immobilize essentially all of the radioactive cesium isotopes which may be present. That is, an effective amount of suitable sized shale particles is added to the waste material together with the alkali metal silicate and silicate hardening agent. Obviously, the optimum amount and size of shale in any given situation can be determined imperically.

To illustrate the present invention, various tests were conducted in which liquid waste contaminated with radioactive cesium isotopes were treated by solidification. Table 1 presents some data which show the benefit obtained via the practice of the present invention. In the first series of tests the waste was solidified by the addition thereto of cement; in the second series of tests the waste was solidified by adding thereto a mixture of water soluble alkali metal silicate and a hardening agent therefor (cement); in the third group of tests the waste was solidified by adding thereto a mixture of water soluble alkali metal silicate, an alkali metal silicate hardening agent and a plurality of shale particles.

In each of the before referred to tests, the specimens were prepared in the same general manner. Specifically, 25 ml of a 5 percent $Na_2SO_4$ solution was used as the waste material in each sample. The dry ingredients utilized (hardening agent and shale, if present) were weighted into a 4 oz. beaker and mixed. Twenty-five ml of the $Na_2SO_4$ solution was then added to the dry material. Next, 0.5 ml of Cs-137 solution containing approximately 0.5 microcurries of Cs-137 in 0.5 normal HCl, carrier free, was added and stirred into the mixture. The silicate was then added and the mix stirred again. The samples were left to solidify in open beakers. Thereafter, 50 ml of leach solution (deionized water adjusted to a pH of 6 with $H_2SO_4$) was added to each beaker. The water was allowed to settle for about 2 hours. Thereafter, 1 ml aliquots of the supernatant liquid were removed, put on a planchet, dried and counted. The counting was conducted over a 9 hour period.

Table 1

| Sample | Ingredients | Counts | Net Counts Per Minute |
|---|---|---|---|
| 1 | Cement 20 g<br>Silicate* 0<br>Shale 0 | (20 min counts)<br>43590 44996 45953 | 2239 |
| 2 | Cement 5 g<br>Silicate* 2 ml<br>Shale 0 | (20 min counts)<br>68771 72217 75011 | 3597 |
| 3 | Cement 5 g<br>Silicate* 2 ml<br>Shale 1 g | (20 min counts)<br>10982 11520 12078 | 523 |

*Specific gravity of 1.4

From the foregoing, it is apparent to those skilled in the art that the leachability of cesium from a solidified mass is greatly reduced when shale is present in the solidified material.

In addition, tests were conducted to show the marked reduction in the leaching of cesium from waste containing samples which were solidified by use of a mixture of cement, alkali metal silicate and shale as opposed to samples which were solidified by the use of a mixture of cement and alkali metal silicate only. Specifically, these tests were conducted as follows.

A plurality of samples were prepared by adding 45 ml of the mock liquid waste to the dry alkali hardening reagent (plus Conasauga shale if used) in a 4 oz. plastic beaker. Then either 5 ml of plain water or 5 ml of water containing 5 micro Ci of Cs-137 tracer was added and the mixture stirred well. The liquid reagent was then added followed by more stirring. The samples were allowed to stand capped overnight so the material could set. The samples are described in Table 2 with the proportion of various ingredients per 25 ml of waste are identified by a three numeral code, for example, 5/2/4, where the first number denotes grams of hardening agents, the second ml of liquid alkali metal silicate (sp. 1.4), and the last number denotes the grams of Conasauga shale. When all samples were hard and dry they were then ground in a mortar and pestle to produce a dry to moist sandy powder and weighed. The activity in the tagged samples was determined before grinding the samples by comparing the gamma count rate of the sample with a solution containing a known amount of Cs-137.

TABLE 2

| SAMPLE | REAGENT RATIO | WASTE |
|---|---|---|
| | Sample Description | |
| 101 | 5/2/0 | 45 ml $H_2O$ + 5 ml $H_2O$ |
| 102 | 5/2/4 | 45 ml $H_2O$ + 5 ml $H_2O$ |
| 103 | 5/2/0 | 45 ml $H_2O$ + 5 ml Cs-137 |
| 104 | 5/2/4 | 45 ml $H_2O$ + 5 ml Cs-137 |
| 105 | 5/2/0 | 45 Ml 5% $Na_2SO_4$ + 5 ml $H_2O$ |
| 106 | 5/2/4 | 45 Ml 5% $Na_2SO_4$ + 5 ml $H_2O$ |
| 107 | 5/2/0 | 45 ml 5% $Na_2SO_4$ + 5 ml Cs-137 |
| 108 | 5/2/4 | 45 ml 5% $Na_2SO_4$ + 5 ml Cs-137 |
| 109 | 10/3/0 | 45 ml W-7* + 5 ml $H_2O$ |
| 110 | 10/3/4 | 45 ml W-7 + 5 ml $H_2O$ |
| 111 | 10/3/0 | 45 ml W-7 + 5 ml Cs-137 |
| 112 | 10/3/4 | 45 ml W-7 + 5 ml Cs-137 |
| 113 | 10/5/0 | 45 Ml 5% $Na_2SO_4$ + 5 ml $H_2O$ |
| 114 | 10/5/4 | 45 ml 5% $Na_2SO_4$ + 5 ml $H_2O$ |
| 115 | 10/5/0 | 45 ml 5% $Na_2SO_4$ + 5 ml Cs-137 |
| 116 | 10/5/4 | 45 ml 5% $Na_2SO_4$ + 5 ml Cs-137 |
| 117 | 15/7/0 | 45 ml W-7 + 5 ml $H_2O$ |
| 118 | 15/7/4 | 45 ml W-7 + 5 ml $H_2O$ |
| 119 | 15/7/0 | 45 ml W-7 + 5 ml Cs-137 |
| 120 | 15/7/4 | 45 ml W-7 + 5 ml Cs-137 |

*W-7 prepared by dissolving 68.5g $NaNO_3$, 27.0g $Na_2CO_3$, 13.35g $Na_2SO_4$, 7.2g NaOH, 5.44g NaCl, 2.78g $Al(NO_3)_3 \cdot 9H_2O$, and 0.24g $NH_4NO_3$ in water and diluting to one liter. Ref. ORNL-4962. "Development of Cementitious Grouts for the Incorporation of Radioactive Wastes, Part 1: Leach Studies", J. G. Moore, et al. April 1975.

These samples were then subjected to leaching tests as described below.

Aliquots of the respective ground samples were leached with deionized water after packing in the barrel of a 30 ml disposable cylindrical syringe.

In this apparatus, the water was flowed through the sample from the top of the syringe. A glass wool plug at the bottom of the syringe and a 5 micrometer membrane filter prevented solid particles from getting into the leachate. Approximately 1 liter of water was passed through each sample. The results are shown in Table 3.

The leach fraction and the specific leach fraction show a marked reduction in the leaching of cesium from the samples containing Conasauga shale by factors varying from 600 to 1900. The "specific leach fraction" as is defined in Table 3 is probably the best way of expressing the leachability of a given sample, because it is less dependent on sample size or leachate volume. Of special interest is the fact that the leach fraction values for samples without shale are all very similar as are the values for all samples with shale, in spite of marked differences in the ratio of reagents other than shale and in the composition of the mock waste. This is clear evidence of the fact that the leachability of cesium from a mass solidified with cement and alkali metal silicate is unexpectedly decreased by the addition thereto of shale.

TABLE 3

LEACH TEST RESULTS

| No. | Waste | Mix | Sample dry wt.(1) | Sample wet wt.(2) | Sample MicroCi(3) | Leachate(4) ml | Leachate(4) Micro Ci | leach(5) fraction | Specific(6) leach fraction |
|---|---|---|---|---|---|---|---|---|---|
| 103 | $H_2O$ | 5/2/0 | 14.5 | 39.1 | 3.50 | 1910 | 2.57 | .733 | $1.50\times10^{-2}$ |
| 104 | $H_2O$ | 5/2/4 | 15.9 | 36.5 | 3.14 | 1410 | $3.10\times10^{-3}$ | $9.86\times10^{-4}$ | $2.56\times10^{-5}$ |
| 107 | $Na_2SO_4$ | 5/2/0 | 23.1 | 46.6 | 4.10 | 920 | 3.47 | .847 | $4.92\times10^{-2}$ |
| 108 | $Na_2SO_4$ | 5/2/4 | 24.5 | 44.9 | 3.78 | 555 | $1.31\times10^{-3}$ | $3.46\times10^{-4}$ | $2.80\times10^{-5}$ |
| 111 | W-7 | 10/3/0 | 26.0 | 40.3 | 2.91 | 930 | 2.39 | .822 | $3.56\times10^{-2}$ |
| 112 | W-7 | 10/3/4 | 30.0 | 44.1 | 3.06 | 930 | $2.18\times10^{-3}$ | $7.12\times10^{-4}$ | $3.38\times10^{-5}$ |
| 115 | $Na_2SO_4$ | 10/5/0 | 23.8 | 29.2 | 1.92 | 938 | 1.61 | .837 | $2.61\times10^{-2}$ |
| 116 | $Na_2SO_4$ | 10/5/4 | 26.2 | 31.2 | 1.95 | 915 | $8.00\times10^{-4}$ | $4.10\times10^{-4}$ | $1.40\times10^{-5}$ |
| 119 | W-7 | 15/7/0 | 31.4 | 36.8 | 1.97 | 930 | 1.72 | .875 | $3.45\times10^{-2}$ |

TABLE 3-continued

LEACH TEST RESULTS

| No. | Waste | Mix | Sample dry wt.(1) | Sample wet wt.(2) | Sample MicroCi(3) | Leachate(4) ml | Leachate(4) Micro Ci | leach(5) fraction | Specific(6) leach fraction |
|---|---|---|---|---|---|---|---|---|---|
| 120 | W-7 | 15/7/4 | 33.6 | 38.6 | 1.98 | 930 | $9.13\times10^{-4}$ | $4.61\times10^{-4}$ | $1.91\times10^{-5}$ |

Notes
(1)Actual weight of the dried ground solid in grams
(2)Calculated weight of the sample in grams immediately after mixing, with no water loss.
(3)Activity in microCi of Cs-137 in the sample.
(4)Volume of leachate collected and Cs-137 activity in the leachate.
(5)The ratio of the activity in the leachate divided by the initial activity in the sample.
(6)The ratio of the microCi/g in the leachate divided by the initial microCi/g in the sample.

Tests were also run to determine whether waste solidified by the addition thereto of cement, alkali metal silicae and shale would removed cesium from the leachate from solidified waste or other solutions. Test samples were prepared by compacting 10 grams of dried sample no. 119, a described in Table 2 (wet wt. 11.7 g) containing 0.63 microCi of Cs-137 in a syringe barrel over 10 grams of the compacted solid under test. Approximately 1 liter of deionized water was then passed through the sample in the manner described hereinbefore. The data in Table 3 indicates that 0.875 of the Cs-137 or 0.55 microCi would be leached from the no. 119 material and pass through the test sample. The results of 2 tests are shown below:

| Sample | dry wt. | wet wt. | leachate ml | leachate μCi | leach fraction |
|---|---|---|---|---|---|
| 117 | 10.0g | 11.4g | 930 | 0.53 | 0.97 |
| 102 | 10.0g | 23.2g | 930 | 0.0012 | 0.0022 (±.0008) |

As expected sample no. 117, which contained no shale, removed very little of the cesium leached from the no. 119 sample above it. However, excellent results were achieved, using a solid made with water and the ingredients described in sample no. 102. The leach fraction was calculated by dividing the total activity in the leachate by the 0.55 μCi calculated to be leached from the 10 grams of no. 119. The error indicated for sample no. 102 is the 95% confidence level based on counting statistics only.

Another specimen having the composition of sample no. 102 was tested in a different manner to determine its ability to remove cesium from a solution leaching through it. Specifically, a 10 g aliquot of no. 102 was loaded in the same apparatus as described above and 930 ml of deionized water containing 0.93 μCl of Cs-137 was passed through it. The leachate contained 0 μCi, giving a leach fraction of $0\pm4.9\times10^{-4}$. The error is the 95% confidence limit of the counting data.

The sample of no. 102 was used above to remove the cesium from solution was removed from the syringe barrel and cut into 8 approximately equal sections plus one section from the top about half the size of the rest. The relative amount of Cs-137 in each section was then determined by counting in a well scintillation counter. The top 6% of the sample contained 69.5% of the Cs-137 and 100% was in the top 18% of the sample, demonstrating a very sharp exchange zone and the capacity for absorption of considerably more cesium in the sample.

From the foregoing, it is quite apparent that the technique of the invention is very effective in removing the cesium from leachate passing through it.

While there have been described what are at present considered to be the preferred embodiments of this invention, it will be obvious to those skilled in the art that various changes and modifications may be made therein without departing from the invention, and it is, therefore, aimed in the appended claims to cover all such changes and modifications as fall within the true spirit and scope of the invention.

What is claimed is:

1. In the method of treating waste material containing radioactive cesium isotopes by mixing said waste material with a water soluble alkali metal silicate and a sufficient amount of an alkali metal silicate hardening agent to form a solidified mass, the improvement which comprises adding an effective amount of particles of shale to said waste material prior to the formation of said solidified mass to immobolize cesium isotopes present in said waste material upon solidification thereof whereby the leachability of said cesium isotopes is significantly reduced when said solidified mass is subjected to an aqueous environment.

2. The method of claim 1 wherein said alkali metal silicate is present as an aqueous solution of alkali metal silicate.

3. The method of claim 2 wherein said aqueous solution of alkali metal silicate has a specific gravity of about 1.4.

4. The method of claim 1 wherein said silicate hardening agent is selected from the group consisting of Portland cement, lime, gypsum and calcium carbonate.

5. The method of claim 4 wherein said silicate hardening agent is cement.

6. The method of claim 1 wherein said particles of shale have a particle size ranging from about through 200 mesh to about 3 millimeters.

7. The method of claim 1 wherein said waste material is a liquid.

8. The method of claim 1 wherein said waste material is solid.

9. The method of claim 7 wherein said waste material is solidified in such a manner that it is essentially encapsulated by a solidified mass formed from a mixture of a water soluble alkali metal silicate, an alkali metal silicate hardening agent and a plurality of shale particles.

10. In the method of treating waste material containing radioactive cesium isotopes by positioning said waste material in a containing landfill, the improvement which comprises forming a solidified barrier layer from a mixture of a water soluble alkali metal silicate, a sufficient amount of an alkali metal silicate hardening agent to solidify said water soluble alkali metal silicate and a plurality of shale particles between said landfill and said waste material said shale particles being present in an amount sufficient to immobilize cesium isotopes which come into contact therewith.

11. The method of claim 10 wherein said landfill is provided with a cavity into which said waste material is to be deposited.

12. The method of treating waste material which contains radioactive cesium isotopes to render said isotopes essentially immobile which comprises:

forming a mixture of said waste material, a water soluble alkali metal silicate, an alkali metal silicate hardening agent and a plurality of shale particles, said alkali metal silicate being present in an amount sufficient to solidify said silicate and said alkali metal silicate and said alkali metal silicate hardening agent being present in an amount sufficient to form a solidified mass which contains said waste material, said shale particles being present in an amount sufficient to immobilize cesium isotope present in said waste material; and solidifying the resultant mixture to form an essentially water insoluble mass which when subjected to an aqueous environment is characterized by the immobility of said radioactive cesium isotopes.

13. The method of claim 12 wherein said alkali metal silicate is present as an aqueous solution of alkali metal silicate.

14. The method of claim 12 wherein said silicate hardening agent is cement.

* * * * *